United States Patent [19]

Thomas

[11] Patent Number: 4,627,798

[45] Date of Patent: Dec. 9, 1986

[54] APPARATUS FOR CIRCULATING CLEANING FLUID THROUGH A COOLING SYSTEM

[76] Inventor: Dalton A. Thomas, Rte. 1, Box 97, Alpine, Ala. 35014

[21] Appl. No.: 858,561

[22] Filed: Apr. 24, 1986

Related U.S. Application Data

[63] Continuation-in-part of Ser. No. 804,765, Dec. 5, 1985, abandoned.

[51] Int. Cl.[4] ..... F04B 35/04; F04B 21/00; B08B 9/00

[52] U.S. Cl. ..... 417/415; 417/437; 417/557; 92/162 R; 92/13.41; 134/169 A

[58] Field of Search ..... 417/550, 555 R, 557, 417/415, 430, 436, 437, 489; 92/162 R, 13.41; 134/169 A

[56] References Cited

U.S. PATENT DOCUMENTS

| | | | |
|---|---|---|---|
| 110,177 | 11/1870 | Ward | 417/557 |
| 1,093,696 | 4/1914 | Guenther | 417/436 |
| 1,942,646 | 1/1934 | Hueber | 417/555 R |
| 2,023,466 | 12/1935 | Crowley | 417/555 R |
| 2,380,604 | 7/1945 | Melton | 134/169 A |
| 2,388,836 | 11/1945 | Dunn | 134/169 A |
| 2,757,617 | 8/1956 | Moore | 417/550 X |
| 2,838,007 | 6/1958 | Johnston | 417/555 R X |
| 4,054,150 | 10/1977 | Thomas | 134/169 A |
| 4,156,584 | 5/1979 | Schuck | 92/162 R X |

*Primary Examiner*—Carlton R. Croyle
*Assistant Examiner*—Paul F. Neils
*Attorney, Agent, or Firm*—Jennings, Carter, Thompson & Veal

[57] ABSTRACT

A single cylinder pump for circulating cleaning fluids through a radiator or like cooling system applies positive and negative pressure to the fluid to create a pulsating agitation of the fluid through the radiator through the use of a thin washer-like plate which is reciprocatively driven within the cylinder. The washer-like plate is slightly smaller than the cylinder and is separated from the inside of the cylinder by a small annular clearance thereby eliminating the need for lubrication and permitting the pump to be self-priming and to release gases generated by the agitation of the fluids.

13 Claims, 5 Drawing Figures

APPARATUS FOR CIRCULATING CLEANING FLUID THROUGH A COOLING SYSTEM

This is a continuation-in-part of Ser. No. 804,765, filed Dec. 5, 1985, now abandoned.

BACKGROUND OF THE INVENTION

The present invention relates to apparatus for cleaning cooling systems such as radiators and engine blocks, and more particularly relates to a simplified self-priming pump mechanism.

In my previous patent, U.S. Pat. No. 4,054,150, I disclosed an apparatus for cleaning a cooling system which utilized a back and forth agitation of cleaning fluid through the system being cleaned and which used negative pressure to cause deposits and the like to be removed from the cooling system. The apparatus disclosed in this patent used a pair of parallel cylinders having pistons mounted for reciprocation therein with each piston being provided with rings to provide a fluid-tight seal with the inner surface of the cylinder. A system of valves provided for major and minor flow within the cooling system responsive to the negative and positive pressure set up by the reciprocation of the piston. The apparatus performed its cleaning function quite satisfactorily; however, the fluid-tight fit of the pistons within the cylinders requires that the piston be lubricated. Unfortunately the lubricant contaminates the cleaning fluid and appreciably shortens the useful life thereof, thus necessitating frequent and costly replacement of the fluid. It is believed that the same problem would occur in any device which produced a negative and positive pressure to urge fluid through a system through the action of a close fitting piston such as may be seen in U.S. Pat. No. 2,380,694 issued to C. C. Melton.

SUMMARY OF THE INVENTION

It is an object of my invention to provide a maintenance free pump for circulating cleaning fluid through a cooling system with alternating pressure agitation which will not contaminate the cleaning fluid.

Another object of the invention is to provide a self-priming, self-lubricating pump for circulating cleaning fluids through a cooling system.

Yet another object of the invention is to provide a pump which will permit the escape of air bubbles formed in the cleaning fluid.

These and other objects and advantages are accomplished in my invention which provides for adequate positive and negative pressure oscillation within the cooling system to clean unwanted corrison and debris therefrom through the use of a single cylinder having an intake port connected to the cooling system and an outlet for discharging cleaning fluid. The cylinder volume is reduced and expanded by a driven washer-like member which reciprocates within the cylinder. The washer-like member is circumferentially spaced from the interior of the cylinder such that a small amount of liquid and air may pass therebetween, yet the pressure within the cylinder may be varied within acceptable levels. A valve which opens responsive to increased pressure within the cylinder allows cleaning fluid to be discharged from the cylinder and, upon closing, causes cleaning fluid to be drawn into the cylinder from the cooling system being cleaned.

DESCRIPTION OF THE DRAWINGS

Apparatus embodying features of my invention are depicted in the accompanying drawings which form a portion of this application and wherein.

DESCRIPTION OF A PREFERRED EMBODIMENT

Figure 1:
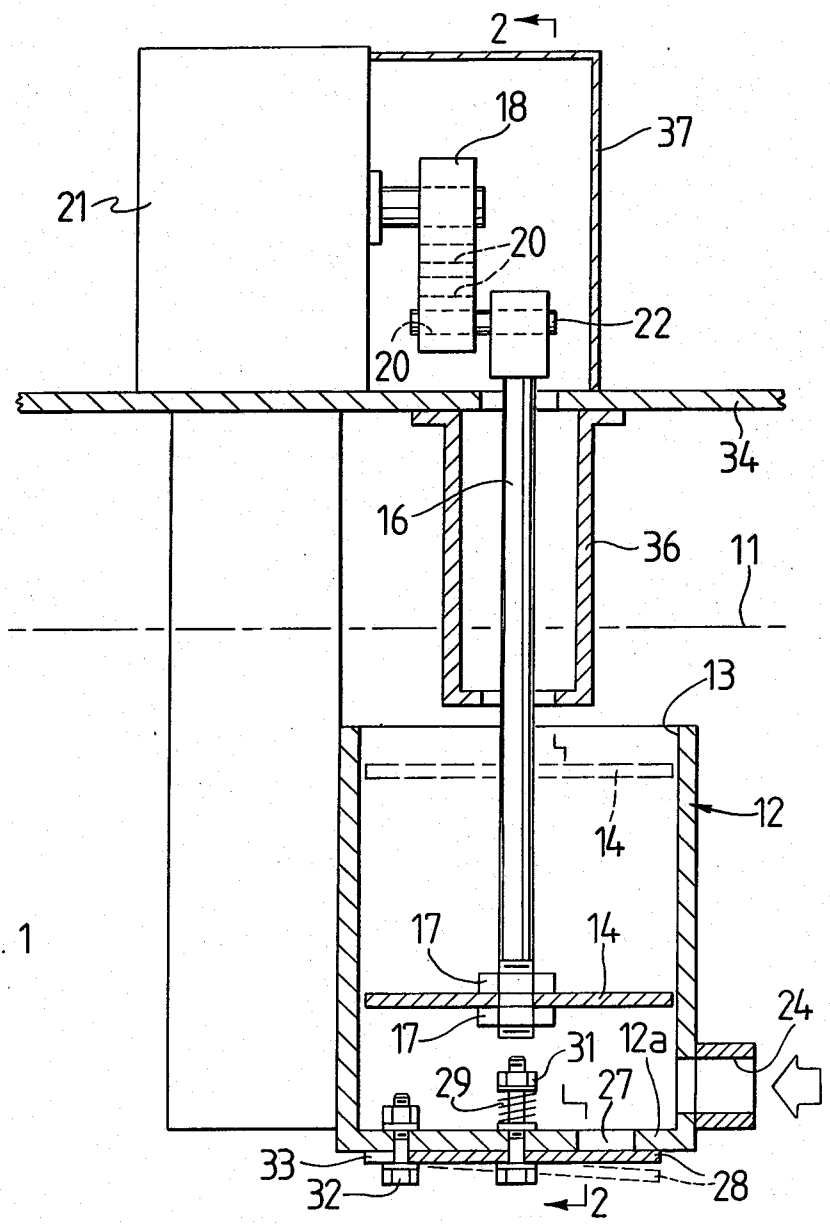
FIG. 1 is an elevational view showing the invention partially in section.
Figure 3:
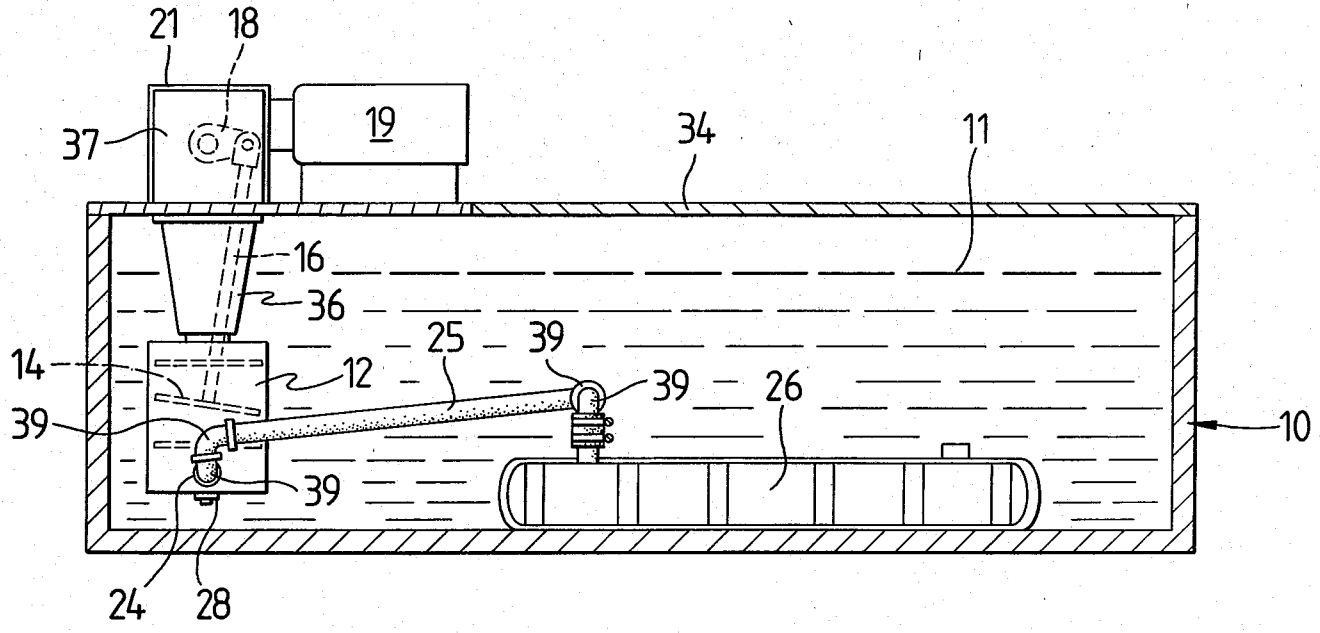
FIG. 3 is a diagrammatic view showing the invention and a reservoir of cleaning fluid.

Referring to FIG. 1 my invention utilizes a reservoir 10 of cleaning fluid having a level indicated at 11. A cylinder 12 having a closed bottom **12*a* is mounted within the reservoir 10 and has an open top 13 which is submerged within a suitable cleaning fluid which may be one of a number of liquid cleaning agents as are commonly used in the art. Within the cylinder 12 is a washer-like member 14 or plate which is rigidly secured to a rod 16. The washer-like member 14 is slightly smaller than the inside diameter of the cylinder 12 such that an annular space of from 0.005 to 0.010 inches wide exists about the circumference of the washer-like member 14**.

The washer-like member 14 is rigidly affixed to rod 16 by fasteners 17, such as threaded nuts or by other suitable means. The opposite end of the rod 16 is attached to a crank 18 by a pin 22 and bearing unit 23. The crank 18 is driven by a motor 19 through a conventional reduction gear unit 21. The pin 22 may be inserted through a selected one of three holes 20 in crank 18 so as to vary the length of the stroke of the washer-like member 14.

The cylinder 12 has an intake port 24 which is operatively connected by a suitable conduit 25 to a cooling system, such as a radiator 26, and an outlet port 27 which discharges cleaning fluid into the reservoir 10. A flap valve 28 is resiliently biased to close the outlet port 27 by a spring 29 coaxially mounted on a nut and bolt unit 31. The resiliency of the spring 29 is overcome by an increase in pressure generated internally of the cylinder 12 to open the valve 28. A bolt 32 extends through an opening in the bottom of the cylinder 12 and rides in an outwardly opening slot 33 provided in the flap valve 28 so as to align the valve 28 with the outlet port 27.

Inasmuch as the cleaning fluid is conventionally heated, I employ a cover 34 to close the top of the reservoir 10. A sleeve 36 depends from the cover 34 and surrounds the rod 16 such that any fluid splashed or forced upwards by the action of the washer-like member 14 is prevented from escaping. The sleeve 36 also prevents heat from escaping through the aperture in the cover around the rod 16. An external housing 37 encloses the rod 16 and crank 18, as shown.

Figure 2:
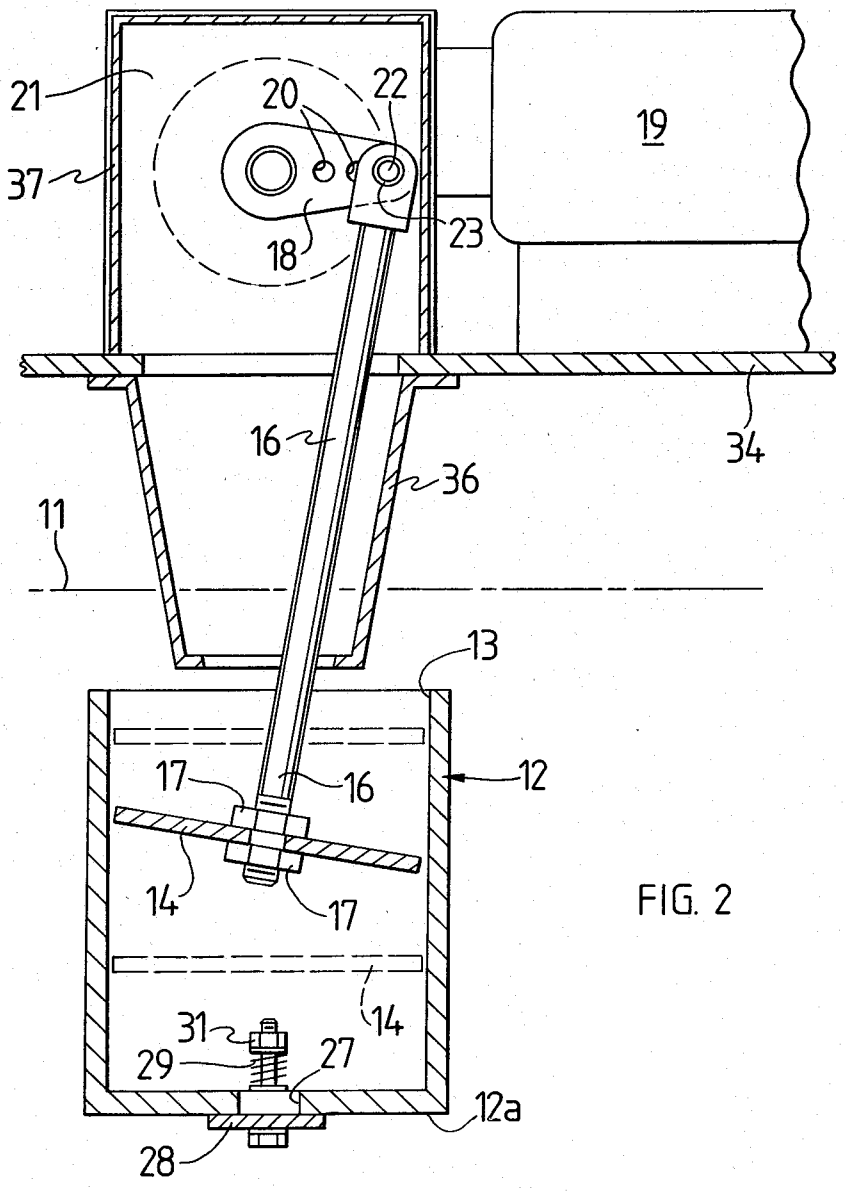
FIG. 2 is a sectional elevational view taken generally along the line 2—2 of FIG. 1.

The key to the operation of my invention is the washer-like member 14. This member 14 is a thin plate approximately one-quarter inch or less in thickness; therefore, it does not bind within the cylinder 12 when the rod 16 is not traveling exactly parallel to the axis of the cylinder 12, as shown in FIG. 2. Contrary to member 14, a conventional piston by virtue of its thickness, requires rings and lubrication to prevent binding even when driven by a pivotally secured push rod. By allowing a small circumferential opening about the member 14, I avoid the necessity for lubrication and at the same time provide an escape path for any air bubbles generated by the pulsating action of the cleaning fluid as it surges through the radiator. Since the cylinder 12 is open at the top and is submerged within the cleaning fluid, this circumferential opening also allows the cylinder 12 to remain constantly primed.

Figure 4:
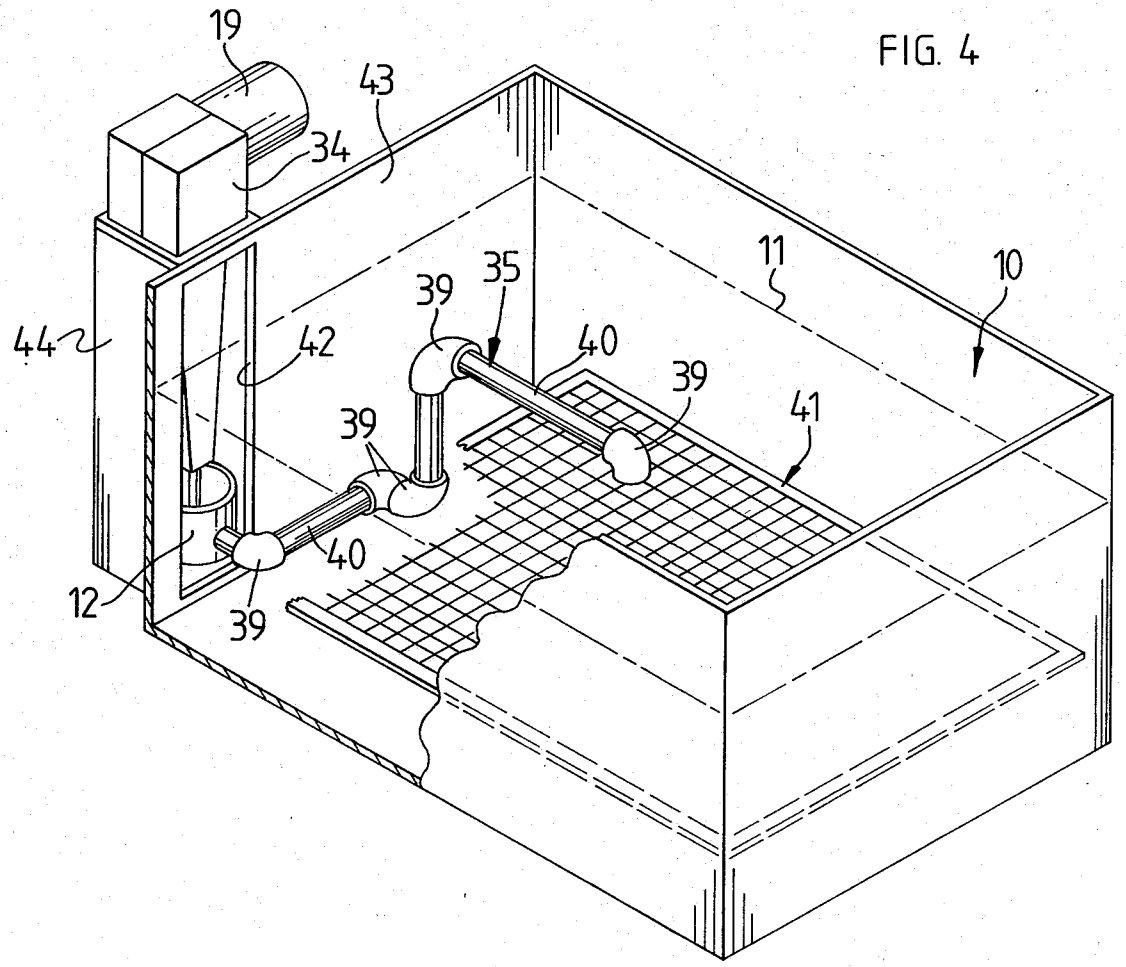
FIG. 4 is a perspective view showing my invention as used with a reservoir containing a movable rack; and, FIG. 5 is an end view with the reservoir shown in section and showing my invention as used with a movable rack.
Figure 5:
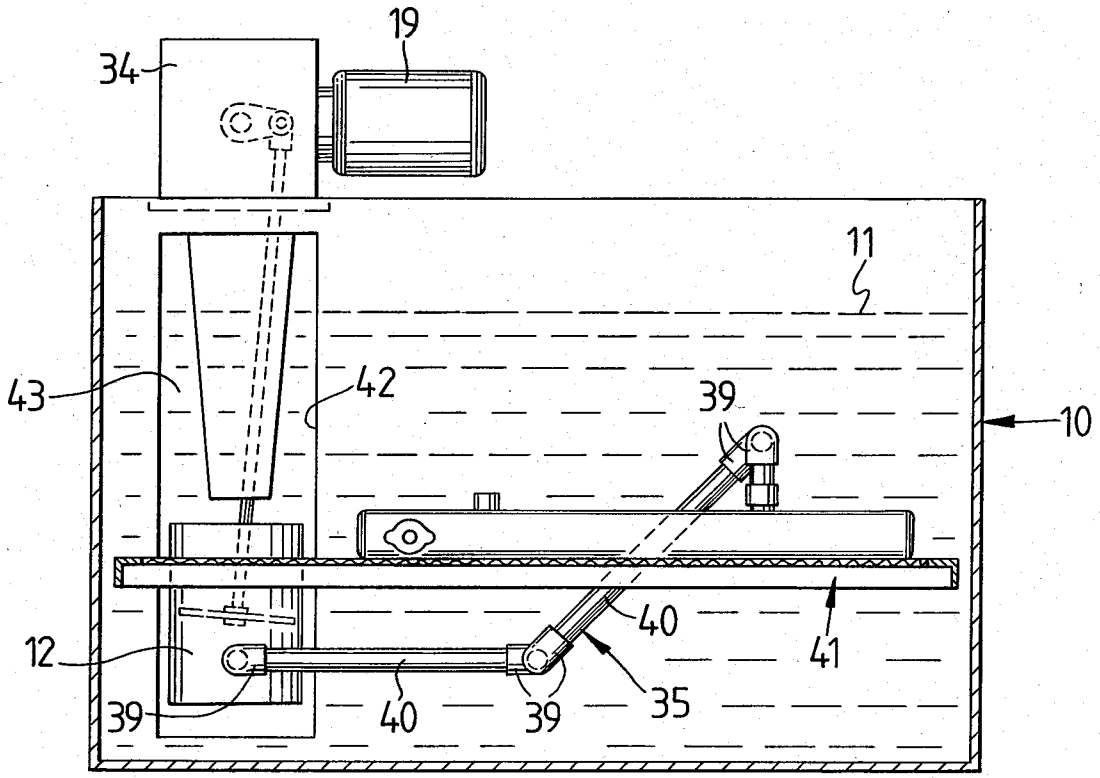

A number of apparatus for cleaning cooling systems, such as radiators, presently exist which utilize a reservoir within which radiators may be supported on a vertically movable rack. The rack allows the radiators to be lowered into or raised out of the cleaning fluid in the reservoir. Such systems may be modified to utilize my invention to improve their operation in the manner shown in FIGS. 4 and 5. It may be seen that in such systems a rack 41 is provided within the reservoir 10 which is almost coextensive with the surface area of the reservoir 10. It will be appreciated that the mechanism for raising and lowering the rack 41 is conventional and has been omitted from the drawings for the sake of clarity. Since the rack 41 is coextensive with the reservoir 10, the components of my invention cannot be placed inside the existing reservoir; therefore an opening 42 is made in one wall 43 of the reservoir 10 and an auxiliary reservoir 44 is formed adjacent the wall 43 such that the cleaning fluid is contained within both reservoir 11 and auxiliary reservoir 44 at the same level 11 and is free to flow from reservoir 10 to auxiliary reservoir 44 and vice versa. The motor 19 and cover 34 are mounted atop the auxiliary reservoir 41 such that cylinder 12 is contained within the auxiliary reservoir 41. An articulated pipe connector 35 made up of L-shaped pipe sections 39 and pipe lengths 40 are connected between the intake port 24 and the cooling system placed on the rack 41, as shown in FIG. 5. The L-shaped pipe sections 29 are rotatable and allow the connector 35 to move in accordance with the movement of the rack 41. Thus the cooling system can be disconnected while in a raised position above the fluid level 11.

In operation, the intake port 24 may be conventionally connected to the drain of the cooling system to be cleaned or if the cooling system is placed within the reservoir 10 a conduit 25 may be provided with a series of L-shaped pipe sections 39 which are rotatable relative to one another and allow the intake port 24 to be connected to a cooling system at almost any attitude within the reservoir 10. As the washer-like member 14 is drawn upward by the rod 16 from the position shown in FIG. 1 to the position shown in FIG. 2, a negative pressure is created within the cylinder 12 and accordingly within the cooling system 26 by virtue of its connection to the intake port 24. Consequently valve 28 is held shut and the entire force of the negative pressure is applied to the cooling system with the same effect as disclosed in U.S. Pat. No. 4,054,150. It will be noted that an air-tight seal is not formed between the washer-like member 14 and the cylinder 12; however when the apparatus is operating in its optimum range of 115 to 120 cycles per minute, adequate negative pressure is generated to urge debris and any other foreign matter from the interior of the cooling system.

As the washer-like member 14 is urged downwardly within the cylinder 12 the pressure therein increases forcing valve 28 open; thus the cleaning fluid within the cylinder 12 is displaced through both the outlet port 27 and the intake port 24 which now forces the cleaning fluid into the cooling system 26. It will be seen that the major flow of cleaning fluid through the cooling system 26 occurs during the upward travel of the washer-like member 14 and a minor flow in the opposite direction occurs during the downstroke.

It will be noted that the washer-like member 14 is perpendicular to the axis of the cylinder 12 only at its maximum displacement; thus the member 14 is usually canted at an angle to the axis of the cylinder as shown in exaggerated form in FIG. 2. It is the thinness of the washer-like member 14 and the circumferential clearance which allows the member 14 to move within the cylinder 12 in this manner. Thus the washer-like member 14 has a rocking motion which, in conjunction with the axial flow of the cleaning fluid and any air bubbles about the outer periphery of the washer-like member and about the inner periphery of the cylinder 12, increases the agitation of the cleaning fluid and enhances the cleaning effect on the cooling system.

While I have shown my invention in but one form, it will be obvious to those skilled in the art that it is not so limited, but is susceptible of various changes and modifications without departing from the spirit thereof.

What I claim is:

1. Apparatus for circulating cleaning fluids from a reservoir thereof through a cooling system submerged in said reservoir comprising:

(a) a cylinder having an open top and a closed bottom mounted within said reservoir with said open top submerged within said cleaning fluid, with said cylinder having an intake port operable connected to said cooling system, and a discharge port communicating with said reservoir;

(b) valve means for opening said discharge port responsive to an increase in pressure within said cylinder and closing said discharge port responsive to decrease in pressure within said cylinder;

(c) a thin washer-like member mounted within said cylinder for reciprocating motion therewithin, with said washer-like member having a predetermined annular clearance from the interior of said cylinder;

(d) drive means mounted externally of said reservoir for imparting reciprocatory motion to said washer-like member within said cylinder; and (e) means for covering said reservoir including an elongated sleeve-like splash guard extending concentrically above said cylinder and adapted to retain heat and fluids within said reservoir.

2. Apparatus as defined in claim 1 wherein said predetermined clearance is from 0.005 to 0.010 inches.

3. Apparatus as defined in claim 1 further comprising an articulated conduit connecting said intake port to said cooling system adapted for movement with said cooling system as said cooling system is raised or lowered within said reservoir.

4. Apparatus as defined in claim 3 wherein said articulated conduit comprises a plurality of pipe lengths connected to each other by a plurality of L-shaped pipe sections rotatably affixed to the ends of said pipe lengths with said articulated conduit connected to said intake port and said cooling system by a L-shaped pipe section at each of said conduit.

5. Apparatus as defined in claim 1 wherein said washer-like member is attached to said drive means by a rod rigidly affixed to said washer-like member.

6. Apparatus as defined in claim 5 wherein said predetermined clearance is from 0.005 to 0.010 inches.

7. Apparatus as defined in claim 5 wherein said washer is driven at 115 to 120 strokes per minute.

8. Apparatus as defined in claim 5 wherein said drive means comprises:

(a) an electric motor; and (b) a crank member driven by said electric motor and having a plurality of apertures therein wherein said rod may be selectively positioned to vary the volume of fluids displaced by said washer during said reciprocating motion.

9. Apparatus for circulating cleaning fluids through a cooling system including a lift means for raising and lowering said cooling system relative to the surface of said cooling fluids within a reservoir, comprising:

(a) an auxiliary reservoir communicating with said reservoir with said cleaning fluids contained within said reservoir and said auxiliary reservoir at the same height;

(b) a cylinder having an open top and a closed bottom mounted within said auxiliary reservoir with said open top submerged with said cleaning fluid, with said cylinder having an intake port operably connected to said cooling system, and a discharge port communicating with said reservoir;

(c) valve means for opening said discharge port responsive to an increase in pressure within said cylinder and closing said discharge port responsive to a decrease in pressure within said cylinder;

(d) a thin washer-like member mounted within said cylinder for reciprocating motion therewithin, with said washer-like member having a predetermined annular clearance from the interior of said cylinder;

(e) drive means mounted externally of said reservoir for imparting reciprocatory motion to said washer-like member within said cylinder; and (f) means for covering said reservoir including an elongated sleeve-like splash guard extending concentrically avove said cylinder and adpated to retain heat and fluids within said reservoir.

10. Apparatus as defined in claim 9 further comprising an articulated conduit connecting said intake port to said cooling system adapted for movement with said cooling system as said cooling system is raised of lowered within said reservoir.

11. Apparatus as defined in claim 10 wherein said articulated conduit comprises a plurality of pipe lengths connected to each other by a plurality of L-shaped pipe sections rotatably affixed to the ends of said pipe lengths with said articulated conduit to said intake port and said cooling system by an L-shaped pipe section at each end of said conduit.

12. Apparatus as defined in claim 9 wherein said washer-like member is attached to said drive means by a rod rigidly affixed to said washer-like member.

13. Apparatus as defined in claim 12 wherein said drive means comprises:

(a) an electric motor; and (b) a crank member driven by said electric motor and having a plurality of apertures therein wherein said rod may be selectively positioned to vary the volume of fluids displaced by said washer during said reciprocating motion.

* * * * *